US006604298B2

(12) United States Patent
Tomasi et al.

(10) Patent No.: US 6,604,298 B2
(45) Date of Patent: Aug. 12, 2003

(54) DRYING APPARATUS

(75) Inventors: Donald Mark Tomasi, Stevensville, MI (US); James I. Czech, Stevensville, MI (US); David E. Scott, St. Joseph, MI (US); Brooke Lindsay-Steel Lau, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/992,876

(22) Filed: Nov. 6, 2001

(65) Prior Publication Data

US 2003/0084590 A1 May 8, 2003

(51) Int. Cl.[7] ..... F26B 11/02

(52) U.S. Cl. ..... 34/600; 34/90; 34/104; 34/106; 34/239

(58) Field of Search ..... 34/60, 90, 104, 34/105, 106, 239, 599, 600

(56) References Cited

U.S. PATENT DOCUMENTS

| | | | | | |
|---|---|---|---|---|---|
| 4,091,548 | A | * | 5/1978 | Daily | 34/600 |
| 5,519,949 | A | * | 5/1996 | Gibson, Jr. | 34/600 |
| 5,743,025 | A | * | 4/1998 | Jordan, Jr. | 34/600 |
| 6,067,723 | A | * | 5/2000 | Lafrenz | 34/61 |
| 6,385,862 | B1 | * | 5/2002 | Vande Haar | 34/441 |

* cited by examiner

*Primary Examiner*—Henry Bennett
*Assistant Examiner*—Kathryn S. O'Malley
(74) *Attorney, Agent, or Firm*—Thomas J. Roth; Robert O. Rice; John F. Colligan

(57) ABSTRACT

A drying apparatus for use in a drying device, having a surface and a first mechanism to at least partially hold an article relative to the surface. A second mechanism associated with the surface is operable to cooperatively engage with an air exit in the drying device, and is in air communication with an interior of the first mechanism. An airflow channel is formed between a portion of the drying device, the article, the interior of the first mechanism, the second mechanism, and an air exit in the drying device, facilitating more even drying of the article.

21 Claims, 5 Drawing Sheets

DRYING APPARATUS

TECHNICAL FIELD

This invention relates to a drying apparatus and, more particularly, to an apparatus for drying articles such as footwear in a drying device.

BACKGROUND

Various types of drying devices are known in the art. Domestic automatic clothes dryers, for example, are drying devices routinely used in households for drying wet or washed laundry, etc. Such automatic clothes dryers typically include a rotating drum operatively connected to a source of heat. During a typical drying process, heat is introduced into the drum while the drum rotates, and the heat is delivered to the contents of the drum, which usually occurs by an air stream generated by an air moving device such as a fan or a blower. Thus, items placed in the drum, such as common household laundry, are dried by the heat and the air stream.

Often times, it is desirable to dry household items other than laundry in a drying device. Footwear, such as shoes for example, may sometimes be washed in a washing machine or by hand, and it may be desirable to dry the washed footwear faster than just letting it sit and air-dry. Shoes loosely placed in the drum of a drying device, however, generate undesirable noise and shoe abrasion when they collide against the walls of the drum when the drum rotates. Devices that hold shoes in place relative to the walls of the drum to help eliminate such noise, however, do not dry the shoes as evenly and thoroughly as is typically desirable. This is usually because the heat, such as the heat in the air stream in the drum, is delivered mostly to the exterior of the shoes. A comparatively minor amount of the heat and air stream, if any, is delivered to the interior of the shoes such as the toe area inside the shoes.

To overcome such problems, shoes are usually removed from the drying device before their interior is fully dry. This is usually not desirable because the shoes are not completely dry when they are removed from the drying device. In other instances, shoes are dried further after their exterior dries until their interior is also dry, but this process wastes energy and can damage the shoes by continuing to apply heat to the already dry exterior of the shoes. Therefore, it is desirable to have footwear drying apparatus that facilitates more even drying of the exterior and the interior of footwear in a drying device.

Accordingly, the present invention is directed to overcoming one or more of the problems as set forth above.

SUMMARY OF THE INVENTION

In one aspect of the present invention, a drying apparatus is disclosed for use in a drying device. The drying apparatus includes a platform with one or more mechanisms, such as tubes, operable to at least partially hold an article to be dried, such as an article of footwear, with respect to the platform. The platform is connected to a second mechanism, such as a screen plug, which cooperatively engages with an air exit in the drying device, such as a lint screen slot. During a drying operation, an article for drying, such as footwear, can be placed on the platform with at least a portion of the first mechanism associated with the article, and the second mechanism can be cooperatively engaged with the air exit. An airflow channel is formed between an interior of the drying device, a portion of the article, the first mechanism, the second mechanism, and the air exit, resulting in more even drying of the article.

In another embodiment, the platform includes a cover, whereby an article placed on the platform is enclosed thereby. In this embodiment, an airflow channel is formed between an interior of the drying device, the first mechanism, a portion of the article, the inside of the enclosure formed by the cover and the platform, the second mechanism, and the air exit, resulting in more even drying of the article.

In another embodiment, a drying apparatus includes a duct unit having an at least partially hollow interior and an air outlet arm operatively connected to the duct unit. The air outlet arm has an at least partially hollow interior, which is in air communication with the at least partially hollow interior of the duct unit and with an opening in the air outlet arm. The duct unit also includes at least one mount having an at least partially hollow interior. The mount is operable to hold an article for drying, such as an article of footwear, with respect to the duct unit. The drying apparatus may also include a frame attached to the duct unit to hold the apparatus in place inside the drying device. When thus placed in the drying device, the opening in the air outlet arm at least partially overlaps with the air exit in the drying device. An airflow channel is formed between an interior portion of the drying device, at least a portion of the article held in the mount, such as the interior of an article of footwear, the at least partially hollow interior of the mount, the at least partially hollow interior of the duct unit, the at least partially hollow interior of the air outlet arm, the opening in the air outlet arm, and the air exit, thereby resulting in more even drying of the article, such as more even drying of the exterior and the interior of a shoe, during a typical drying operation.

DETAILED DESCRIPTION OF THE PREFERRED EMBODIMENTS

Figure 1:
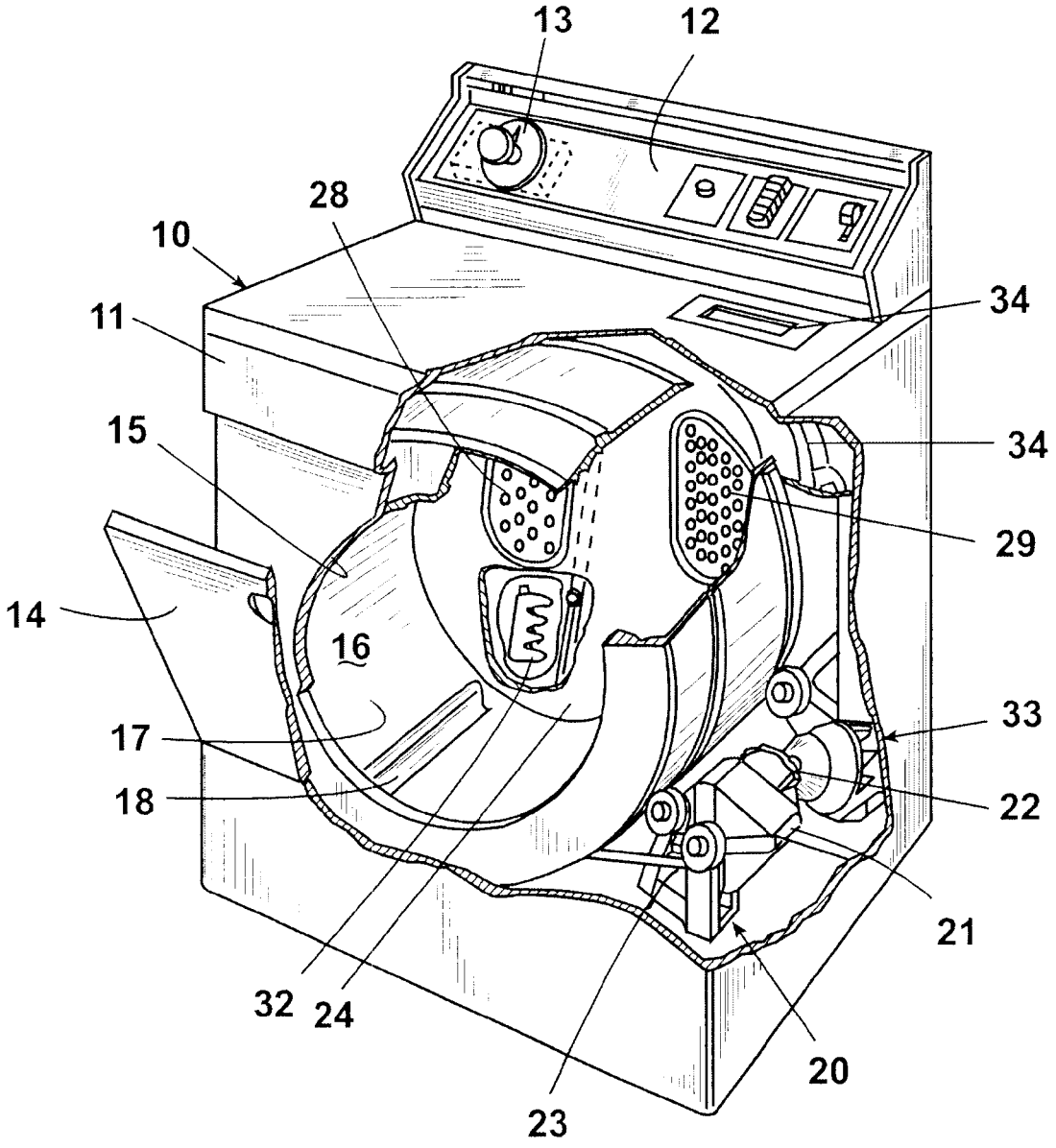
FIG. 1 is a partly broken away perspective view of a typical drying device.

Referring to the drawings, a domestic automatic clothes dryer is shown generally at 10 in FIG. 1. The dryer has a standard cabinet 11 having a control panel 12, including a control dial 13 for a presettable control means by which the dryer may be pre-set to automatically operate through a programmed sequence of a drying operation. A hinged door 14 opens on the front face of the cabinet 11. Behind the door 14 is a receptacle opening 15 through which clothes or other items to be dried may be deposited in a treatment zone 16, characterized in this form of the invention by a drum 17 in the form of an imperforate cylindrical sidewall having radially inwardly extending vanes 18. Suitable drive means 20, including an electric motor 21, drive shaft 22, and pulley means 23 connected to the drive shaft 22 at the front side of the motor 21, rotate the drum 17. It should be understood that any drum construction could be used herein in the treatment zone 16 in which materials are to be dried, so long as a stream of temperature conditioned air is directed through the zone 16 to enhance the drying operation.

Figure 2:
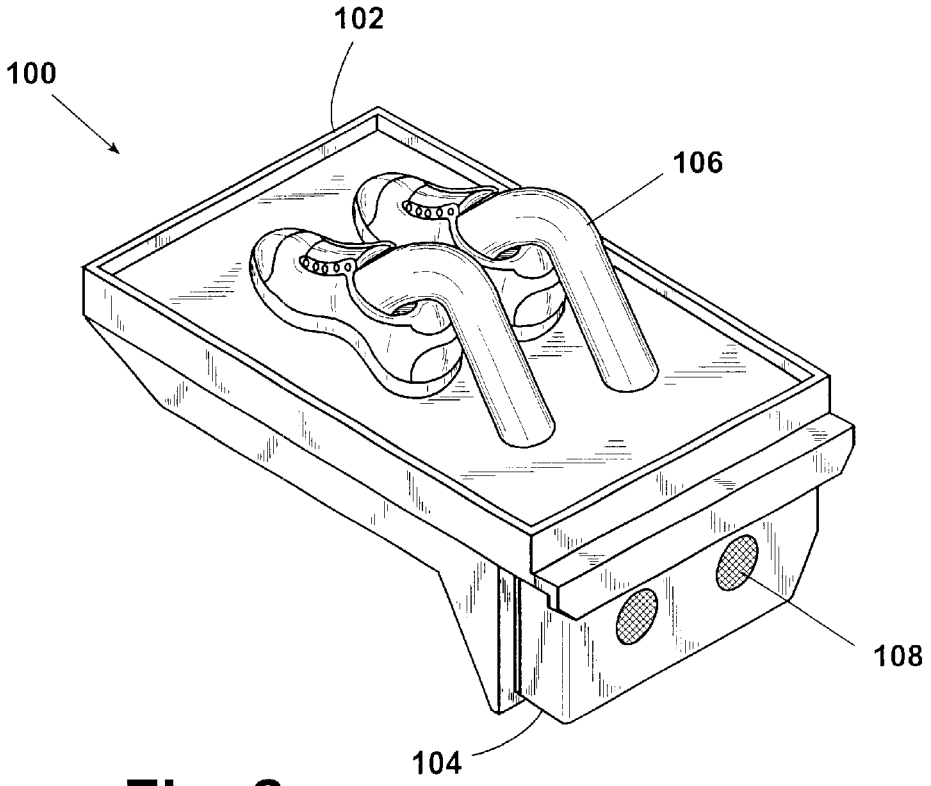
FIG. 2 is an elevated perspective view of a drying apparatus usable in a typical drying device according to one embodiment of the present invention.

Referring to FIG. 2, an elevated perspective view of a drying apparatus 100 usable in a typical drying device according to one embodiment of the present invention is shown. The drying apparatus 100 includes a platform or plate 102 operatively connected to a screen plug 104. The plate 102 is substantially flat in one embodiment, although a different shaped plate may be used without departing from the spirit and scope of the present invention. For example, the plate 102 may have a slightly curved surface, or it may be shaped to conform to the shape and dimensions of the bottom of a shoe, or a pair of shoes, in alternate embodiments of the present invention.

The screen plug 104 is designed and constructed to cooperatively engage with a lint screen slot in the corresponding drying device, whereby the screen plug 104 can plug into the lint screen slot. Lint screen slots are usually implemented in drying devices to accommodate a removable lint screen. The removable lint screen serves to trap lint that is expelled from laundry during a drying operation. A substantial portion of a stream of air exiting the drum of the drying device during the drying operation passes through the lint screen, whereby the lint screen can trap the lint carried therein. The lint screen slot is typically separate from the drum and is stationary with respect to the drying device irrespective of whether the drum rotates or not, although it is recognized and anticipated that the present invention is also applicable in drying devices wherein the lint screen also rotates with the drum. Those skilled in the art will appreciate that screen plug 104 will be shaped substantially like the lint screen of the particular drying device so that it can be removably plugged into the lint screen slot. In this regard, it is recognized and anticipated that the shape and design of the screen plug 104 will vary in alternate embodiments in order to correspond to the particular drying device that the particular drying apparatus 100 is intended for. Those skilled in the art will appreciate that such modification of the present apparatus is relatively simple for those skilled in the art, and such modification will keep with the spirit and scope of the present invention.

The drying apparatus 100 includes at least one air communication channel, which is in air communication with a corresponding air outlet in the screen plug 104. In one embodiment, the drying apparatus 100 has two air communication channels, each of which is a tube 106 as shown in FIG. 2. The tubes 106 have an at least partially hollow interior. Each tube 106 is in airflow communication with a corresponding air outlet 108 in the screen plug 104. Each tube 106 also has one or more air inlet holes (hidden from view inside the shoes) at an end opposite from the air outlet 108. Each tube 106, therefore, serves as a conduit for airflow between the air outlet 108 and the air inlet holes in the end opposite from the air outlet 108.

Although the drying apparatus 100 depicted in FIG. 2 has only two tubes 106, it is recognized and anticipated that other embodiments of the present invention may have more, such as 4, or less, such as 1, tubes 106. Further, each tube 106 of the embodiment depicted in FIG. 2 is in air communication with a separate air outlet 108, it is recognized and anticipated that other embodiments of the present invention may have just one air outlet 108, or a different number of air outlets 108, operatively connected to each tube 106.

As shown in FIG. 2, an article, such as a shoe, can be placed on the drying apparatus 100 for each tube 106 for drying. The shoe is placed on the plate 102, and the end of the tube 106 with the air inlet holes is inserted into the interior of the shoe. In this manner, the shoe rests on the drying apparatus 100, and the tube at least partially holds the shoe on the platform 102 with respect to the drying apparatus 100. With the tube 106 thus inserted in the shoe, some of the air inlet holes are in close proximity with the toe area in the interior of the shoe. Also, the diameter of the tubes 106 is preferably appropriately sized so that there is room for at least some air flow around the tube 106 in at least the portion of the tube 106 that extends into the interior of the shoe. The purpose thereof will be more apparent from the discussion below. Further, other inlet holes may be implemented strategically in the tubes 106 or apparatus 100 to aid in more uniform drying of the interior of the shoe.

Figure 3:
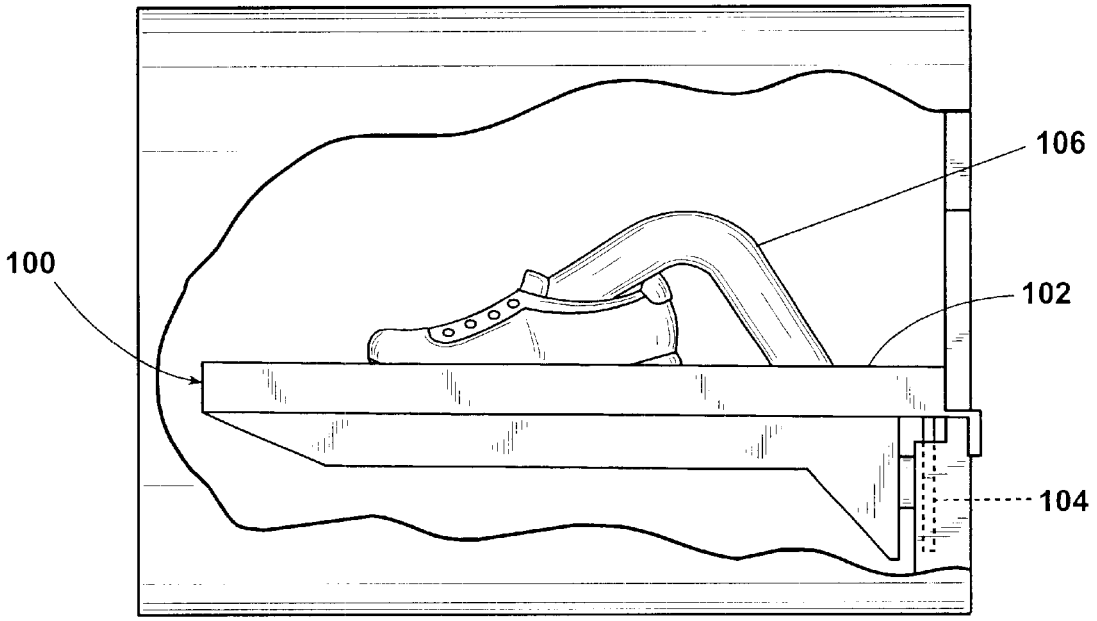
FIG. 3 is a partially broken away side view of the drying apparatus of FIG. 2 in a drum area of a typical drying device.

Referring to FIG. 3, a partially broken away side view of the drying apparatus 100 in a drum area of a typical drying device is shown. Essentially, the screen plug 104 of the drying apparatus 100 is cooperatively engaged with, such as being inserted into, the lint screen slot of the drying device. Thus cooperatively engaged, the plate 102 is suspended in cantilever fashion inside the drum area of the drying device. However, the drying apparatus 100 is isolated from the rotating drum, whereby the drum rotates (in an embodiment wherein the drum rotates) around the drying apparatus 100 during a drying process.

Those skilled in the art will appreciate that the screen plug 104 substantially covers up the main air exit from the interior of the drum of the drying device during a drying operation. Accordingly, a substantial portion of the air stream exiting from the drum during a drying operation must pass through the screen plug 104 before exiting the drum area of the drying device. Since air outlets 108 are the only openings in the screen plug 104, such air must travel through the tubes 106 in order to reach the air outlets 108 and to exit the drum area through the lint screen slot. It will be appreciated that such air must enter the tubes through the air inlet holes at the end of the tubes opposite from the screen plug 104. To reach the air inlet holes at the end of the tubes, such air must first travel through the article placed on the plate 102 and associated with the tube 106, such as through the interior of a shoe and about the toe and heel areas in the interior of the shoe, around the exterior surface of the tube 106. In this manner, it will be appreciated that during a drying process, a substantial portion of the air stream in the drum of the drying device will travel through an air channel formed between a portion of the interior of the drying device such as the drum area, the interior of the shoes, including the relatively hard-to-reach toe areas therein, the air inlet holes in the tubes 106, the at least partially hollow interior of the tubes 106, the air outlets 108 in the screen plug 104, and the lint screen slot, before exiting the drum. This will result in more even drying of the exterior and the interior of the shoes during a typical drying operation.

Figure 4:
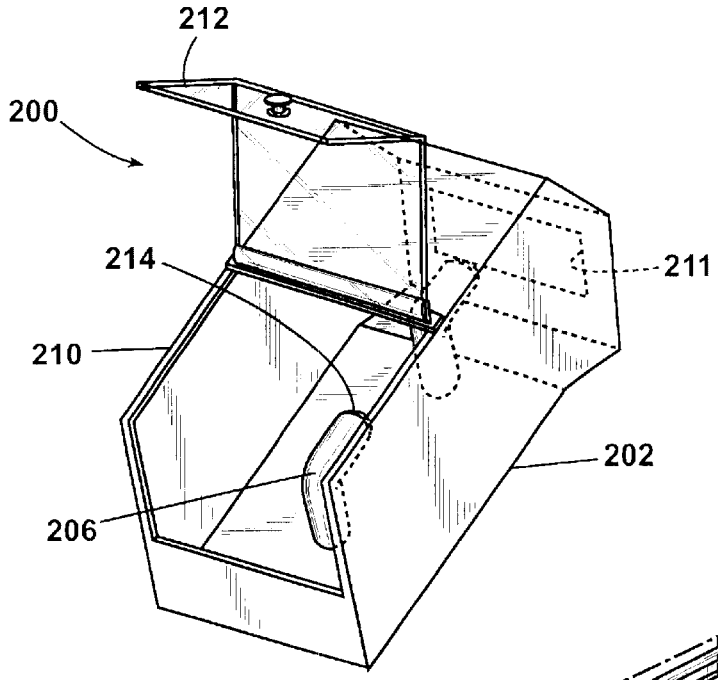
FIG. 4 is an elevated perspective phantom view of a drying apparatus usable in a typical drying device according to an alternate embodiment of the present invention.

Referring to FIG. 4, an elevated perspective phantom view of a drying apparatus 200 usable in a typical drying device according to an alternate embodiment of the present invention is shown. The drying apparatus 200 includes a plate, or platform, 202 and a cover 210. The cover 210 essentially creates an enclosure above the platform 202 as shown in FIG. 4. Further, the cover 210 preferably includes an access mechanism, such as a hinged door 212, to allow access to the interior of the enclosure formed by the cover 210. Although the access mechanism in the embodiment depicted in FIG. 4 is a hinged door, it is recognized and anticipated that any other access mechanism or apparatus known in the art may be implemented instead of a hinged door without departing from the spirit and scope of the present invention. One side of the covering 210 includes a screen plug 204 (hidden from view in FIG. 4, but visible in FIG. 5) designed and constructed to perform substantially as described for screen plug 104 above. The screen plug 204 facilitates air communication between the interior and the exterior of the apparatus 200 formed by the cover 210 through the screen plug 204, such as through an opening 211 in the screen plug 204. The plate 202 also includes at least one air communication device having an at least partially hollow interior, such as a tube 206, which could be of any shape such as straight, curved, or angled, etc. In the embodiment shown in FIG. 4, there are two tubes 206, both angled in shape, although it is recognized and anticipated that a different number of tubes 206 of different shapes may be implemented in alternate embodiments without departing from the spirit and scope of the present invention. One end of the tubes 206 includes one or more air inlet holes 214 at one end, and the other end is in air communication with the exterior of the enclosure formed by the plate 202 and the cover 210.

Figure 5:
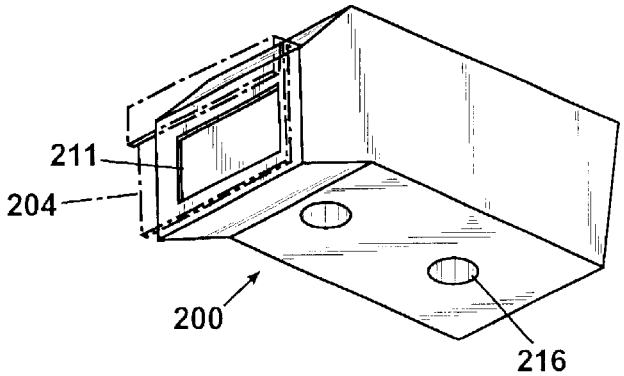
FIG. 5 is a lower perspective view of the drying apparatus of FIG. 4.

Referring to FIG. 5, a lower perspective view of the drying apparatus 200 is shown. The drying apparatus 200 includes the screen plug 204, which, as discussed above, is designed and constructed to cooperatively engage with the lint screen slot of the corresponding drying device. Also visible are openings 216, which are designed to facilitate air communication between the exterior of the drying apparatus 200 and the interior of a corresponding tube 206. In this regard, it will be appreciated that the number of openings 216 will typically correspond to the number of tubes 206 implemented in the particular embodiment of the present invention.

In this configuration, an article for drying, such as a shoe, can be placed upon the tube 206. (A pair of shoes placed on tubes 206 are shown in phantom in FIG. 6.) It will be appreciated that the air inlet holes 214 will be in the interior of the shoe, in relatively close proximity to the toe area in the interior of the shoe, when a shoe is placed upon the tube 206. The drying apparatus 200 can then be placed inside the drum of a drying device by cooperatively engaging the screen plug 204 with the lint screen of the drying device. Thus implemented, the drying apparatus 200 will be suspended in the drum area of the drying device in cantilever fashion, whereby the drum can rotate around the drying apparatus 200 during a drying cycle while the drying apparatus 200 remains stationary relative to the drying device. It is recognized and anticipated, however, that the apparatus 200 can also be implemented in an embodiment wherein the drying apparatus 200 will also rotate with the drum.

During a typical drying operation, the air stream inside the drum area exits in substantial part through the lint screen slot. But, because the lint screen slot is preferably substantially covered by the screen plug 204, the air, in order to exit the drum area, must travel in substantial part through an airflow channel formed between the drum area in the drying device, the opening 216 in the apparatus 200, through the corresponding tube 206, through the air inlet holes 214 in the tube 206, through at least a portion of the article on the tube 206, such as the toe area in the interior of a shoe, around the exterior surface of the tube 206, into the interior of the enclosure formed by the cover 210, through the opening 211 in the screen plug 204, and through the lint screen slot of the drying device. It is recognized that some air will leak through the seam between the hinged door 212 and the cover 210, which will travel in substantial part over the exterior of the article only, such as over the exterior surface of a shoe. Combined, therefore, the air stream in the drum area of a drying device during a drying operation will come in contact with both the interior and the exterior of an article such as a shoe before exiting the drum area. This will result in a comparatively more even drying of the interior and the exterior of the shoes or other article being dried in the drying device.

Figure 6:
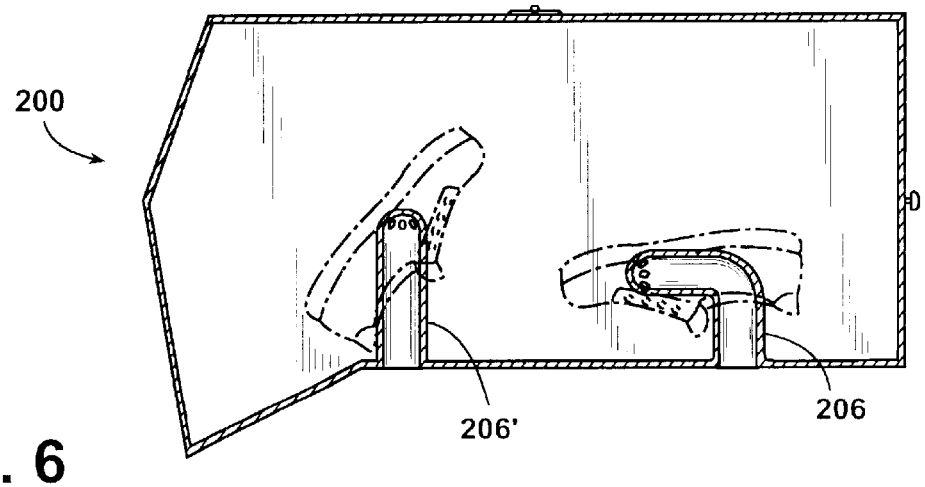
FIG. 6 is a side view of the drying apparatus of FIG. 4 with two different embodiments of airflow conduits having shoes implemented thereon in phantom.

Referring to FIG. 6, a side view of the drying apparatus 200 with two different embodiments of airflow conduits, or tubes 206, having shoes implemented thereon in phantom is shown. This embodiment depicts two different types of air communication devices, such as tubes 206 and 206' having an at least partially hollow interior, that may be implemented in the drying apparatus 200. The tube 206 is angled in shape, whereas the tube 206' is relatively straight. It is, however, recognized and anticipated that those skilled in the art can implement other shapes of air communication devices instead of those depicted in the figures while keeping with the spirit and scope of the present invention.

FIG. 6 also shows in phantom how shoes can be implemented on each of the hollow tubes 206 and 206' for drying in the drying device during a typical drying operation.

Figure 7:
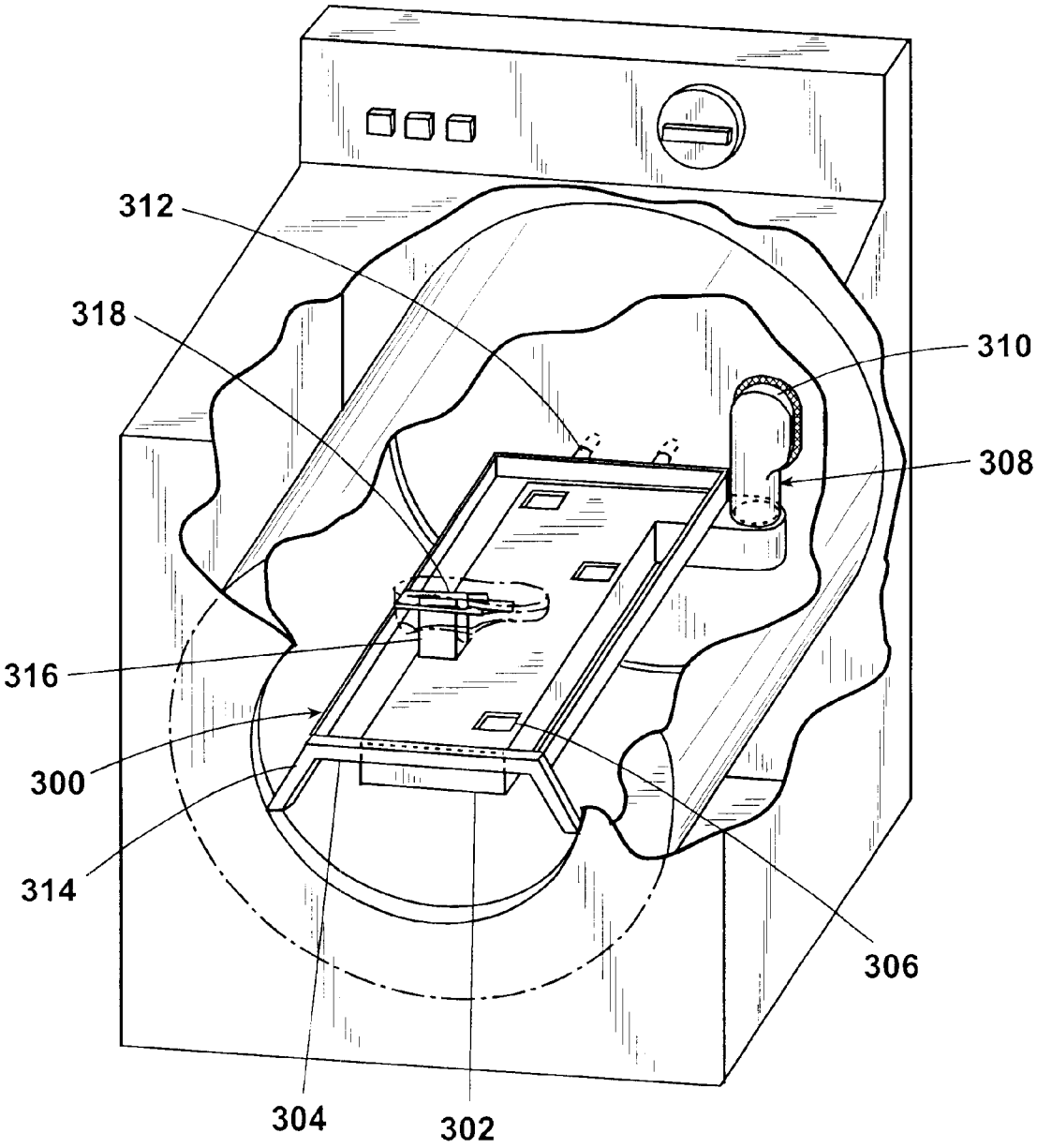
FIG. 7 is a partially broken away view of a typical drying device showing a drying apparatus according to an alternate embodiment of the present invention implemented therein.

Referring to FIG. 7, a partially broken away view of a typical drying device with a drying apparatus 300 according to an alternate embodiment of the present invention is shown. The drying apparatus 300 includes a duct unit 302 having an at least partially hollow interior. In one embodiment, the duct unit 302 is relatively rigidly attached to a frame 304. The duct unit 302 is preferably of a thickness that allows a desirable amount of airflow therethrough, and the shape thereof according to one embodiment is as shown in FIG. 7. It is recognized and anticipated though that the thickness and the shape of the duct unit 302 may vary in other embodiments without departing from the spirit and scope of the present invention. The duct unit 302 includes at least one duct hole 306, which is an opening in the duct unit that allows air communication through the walls or surface of the duct unit at the location of the duct hole 306. The duct unit 302 also includes an air outlet arm 308. The air outlet arm 308 is preferably pivotable with respect to the duct unit 302, although it may also be rigid or flexible, etc., with respect thereto in alternate embodiments. The air outlet arm 308 has a head portion 310 which has an opening in the portion thereof that faces the air exit socket (hidden from view). The opening in the head portion 310 is preferably designed to adapt substantially to the shape and dimensions of an air exit socket in the drying device. Typically, drying devices have an air exit socket in air communication with the drum area of the drying device for air to exit from the drying device after coming in contact with the contents of the drum during a drying operation. The shape and dimensions of the opening in the head portion 310 of the air outlet 308 do not have to exactly conform to the shape and dimensions of the air exit socket of the corresponding drying device, so they may be slightly oversized or undersized, but it is preferable that they be considerably similar for better performance of the drying apparatus 300. In one embodiment, the head portion 310 of the air outlet arm 308 only partially covers the air exit socket so that sufficient airflow can occur through the apparatus and the article or shoes thereon, but yet airflow is not completely restricted in the drying device such that a safety condition may be tripped or exceeded. The air outlet arm 308 and the head portion 310 have an at least partially hollow interior, which is in air communication with the opening in the head portion 310 and the interior of the duct unit 302.

The frame 304 is constructed of any material known in the art, and is designed to serve the purpose of holding the duct unit 302 in place with respect to the drying device during a drying operation. In this regard, the frame 304 can be constructed of the same material as the duct unit 302 in one embodiment. The frame 304 includes one or more pins 312 substantially rigidly attached thereto. The pins 312 are designed to cooperatively engage with corresponding indentations, or grooves, in the stationary back wall of the corresponding drying device in the embodiment shown. The frame 304 also includes one or more legs 314. The legs 314 and the pins 312 are preferably integrally constructed of the same material as the frame 304 for ease and economy of manufacturing and construction construction, although it is recognized and anticipated that they may be constructed separately and/or of a different appropriate material.

In this configuration, the drying apparatus 300 can be implemented in the drum of a corresponding drying device as shown in FIG. 7. The pins 312 cooperatively engage with corresponding indentations at the back of the drum area of the drying device, and the legs 314 rest upon a ledge or lip at the front of the drum area of the drying device. With the apparatus 300 thus placed in the drum area, the drum or drum-band can rotate around the drying apparatus 300 during a drying operation while the drying apparatus 300 remains stationary with respect to the drying device. Further in this configuration, the opening in the head portion 310 of the air outlet arm 308 abuts against the air exit socket. The opening in the head portion 310 faces the air exit socket, which facilitates air communication therebetween.

The drying apparatus 300 also includes a mount 316 for each duct hole 306. Each mount 316 has an at least partially hollow interior, and can be either substantially fixedly or removably attached to the duct unit 302 at the duct hole 306. The mounts 316 are used for holding an article, such as a shoe, relative to the apparatus 300 for drying during a drying operation. In one embodiment, the mounts 316 include a slide mechanism 318 that can be extended to hold a shoe thereon, and retracted to remove the shoe with comparatively more ease. FIG. 7 shows a shoe in phantom implemented on a mount 316 with the slide mechanism 318 extended to hold the shoe.

During a drying operation, air in the drum area of the drying device must typically pass through the air exit socket in order to exit the drum area of the drying device. With the drying apparatus 300 implemented in the drying device, a significant portion of the air exit socket, even perhaps all of it in some embodiments, will be covered by the opening in the head portion 310. Accordingly, for air to exit the drum area of the drying device through the air exit socket, the air will travel along an airflow channel formed between: around the exterior surface of a mount 316, through the interior of the article, such as the toe area of a shoe, through the at least partially hollow interior of the mount 316, through the at least partially hollow interior of the duct unit 302, through the at least partially hollow interior of the air outlet arm 308, through the opening in the head portion 310 of the air outlet arm 308, and the air exit socket of the drying device. Those skilled in the art will appreciate that this will result in more even drying of the interior and the exterior of the article, such as a shoe, because the air in the drum area will come in contact with the exterior of the shoe, and then with the interior of the shoe when it travels through the drying apparatus 300 before exiting the drum area of the drying device, resulting in more even drying of the exterior and the interior of the article.

Figure 8:
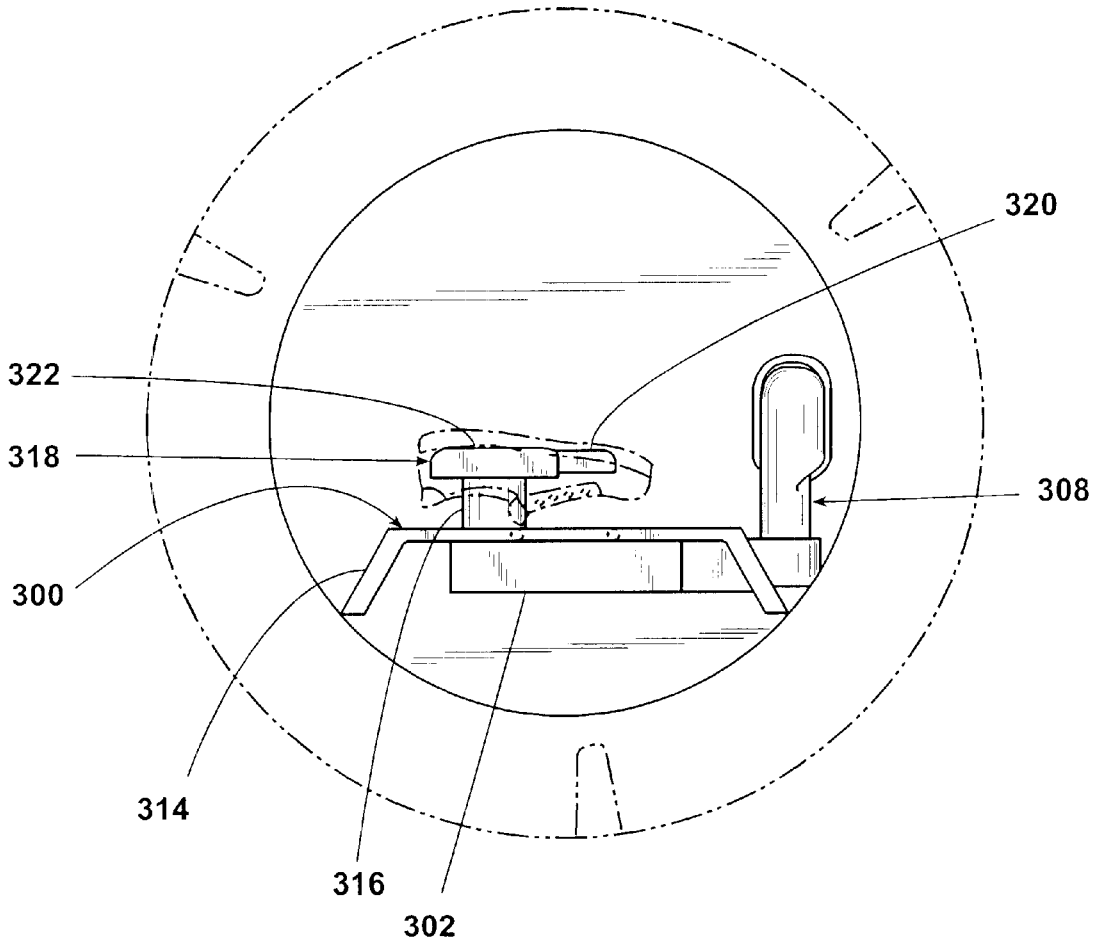
FIG. 8 is a phantom front view of the drying apparatus of FIG. 7 implemented in the drum of a typical drying device.

Referring to FIG. 8, a phantom front view of the drying apparatus 300 implemented in the drum area of a typical drying device is shown. More particularly, FIG. 8 shows the slide mechanism 318 of a mount 316 in an extended position to hold a shoe, which is shown in phantom. The slide mechanism 318 includes a slider 320 slidably disposed in a slide 322. In one embodiment, the slider 320 has one or more rails that cooperatively engage with one or more corresponding grooves in the slide 322. The cooperative engagement between the rails in the slider 320 and the grooves in the slide 322 permits the slider 320 to slide with respect to the slide 322. The slide 322 and slider 320 preferably also include a mechanism, such as another extension (hidden from view in the figures) in the slide 322 that acts as a stop, to prevent the slider 320 from completely sliding out of the slide 322

As is evident from the foregoing description, the aspects of the present invention are not limited to the particular details of the examples illustrated herein, and it is therefore contemplated that other modifications and applications will occur to those skilled in the art. For example, alternate embodiments of the present invention may have a different mechanism to hold shoes instead of the slide and slider combination discussed above. An alternate embodiment may have a stud or mount to simply slide a shoe thereon, or the like. Other embodiments may have more mounts or tubes to accommodate more shoes for one drying operation. For example, an alternate embodiment may have four mounts or tubes to accommodate two pairs of shoes. It is, accordingly, intended that the claims shall cover all such modifications and applications that do not depart from such spirit and scope of the present invention.

Other aspects, objects and advantages of the present invention can be obtained from a study of the drawings, the disclosure and the appended claims.

The embodiments of the invention in which an exclusive property or privilege is claimed are defined as follows:

1. A drying apparatus for use in a drum area of a drying device, the drying apparatus comprising:

a substantially horizontal platform configured to at least partially support an article;

a first mechanism on the platform, configured for at least partial insertion into the article, the first mechanism having an at least partially hollow interior, and the first mechanism including an air communication passage which allows air communication between the at least partially hollow interior of the first mechanism and the article;

a second mechanism associated with the platform, the second mechanism operable to interface with an air exit in the drying device, the second mechanism in air communication with the at least partially hollow interior of the first mechanism, wherein an airflow channel is formed between the drum area, at least a portion of the article, the at least partially hollow interior of the first mechanism, the second mechanism, and the air exit.

2. The drying apparatus of claim 1, wherein the first mechanism is a tube.

3. The drying apparatus of claim 1, wherein the first mechanism is a mount with a slide mechanism.

4. The drying apparatus of claim 1, wherein the second mechanism includes a screen plug operable to cooperatively engage with a lint screen slot in the drying device.

5. The drying apparatus of claim 1, wherein the second mechanism is an air outlet arm with a head portion having an opening, the opening abutting against at least a portion of the air exit when the drying apparatus is placed in the drum area.

6. The drying apparatus of claim 1, wherein the article is an article of footwear.

7. A drying apparatus for use in a drum area of a drying device, the drying apparatus comprising:

a platform configured to at least partially support an article;

a cover configured to substantially enclose the platform;

at least one air communication channel operatively connected to the platform and having an at least partially hollow interior, at least a portion of one air communication channel configured to be inserted in the article; and an air communication device operatively connected to the platform and in air communication with the at least partially hollow interior of the at least one air communication channel, wherein an airflow channel is formed between the drum area, an interior of the article, the at least partially hollow interior of the air communication channel, the air communication device, and an air exit in the drying device.

8. The drying apparatus of claim 7, wherein the air communication channel further comprises at least one hole.

9. The drying apparatus of claim 7, wherein the air exit is a lint screen slot and the air communication device is a screen plug operable to cooperatively engage with the lint screen slot.

10. The drying apparatus of claim 7, wherein the air communication channel is a tube.

11. The drying apparatus of claim 7, further comprising two air communication channels operatively connected to the platform, each having an at least partially hollow interior, and each operable to at least partially hold a respective article with respect to the platform with at least a portion thereof inserted in the respective article.

12. The drying apparatus of claim 7, wherein the cover further comprises a door hingedly attached to the cover for providing an access mechanism.

13. A drying apparatus for drying an article in a drying device, comprising:

a duct unit having an at least partially hollow interior;

a substantially rigid frame configured to extend from the back of the drum area to the front of the drum area for supporting one or more articles in the drum, the frame being connected to the duct unit and configured to hold the duct unit relative to the drying device;

an air outlet member having an at least partially hollow interior and operatively connected to the duct unit, the outlet member having an opening, and the at least partially hollow interior of the air outlet member in air communication with the opening and the at least partially hollow interior of the duct unit; and at least one mount operatively connected to the duct unit; the mount having an at least partially hollow interior which is in air communication with the at least partially hollow interior of the duct unit, and the mount operable to hold the article, wherein the opening in the air outlet member cooperatively engages with an air exit in the drying device, and an airflow channel is formed between an interior portion of the drying device, at least a portion of the article, the at least partially hollow interior of the at least one mount, the at least partially hollow interior of the duct unit, the at least partially hollow interior of the air outlet member, the opening in the air outlet member, and the air exit.

14. The drying apparatus of claim 13, wherein the mount includes a slide mechanism comprising a slider slidably disposed in a slide, the slider being slidably extendable with respect to the slide to hold the article with respect to the drying apparatus.

15. The drying apparatus of claim 14, wherein the article is an article of footwear.

16. The drying apparatus of claim 13, further comprising at least one pin connected to the frame, the at least one pin operable to cooperatively engage with a corresponding indentation in the drying device.

17. The drying apparatus of claim 13, wherein the frame includes at least one leg which is operable to rest on a ledge or a lip in the drying device.

18. The drying apparatus of claim 13, wherein the air outlet member has a head portion that covers at least a portion of the air exit, and the head portion includes the opening in the air outlet member.

19. The drying apparatus of claim 18, wherein the air outlet member is pivotable with respect to the duct unit.

20. A support device for use with a drying device, wherein the drying device includes a drying chamber for receiving articles to be dried with an airflow inlet and an airflow outlet communicating with the drying chamber and a mechanism for creating an airflow through the drying chamber via the airflow inlet and the airflow outlet during operation of the drying device, the support device comprising:

a platform configured to at least partially support an article;

a first support element on the platform, the first element configured to provide at least additional support for the article relative to the platform, the first support element having an at least partially hollow interior, and the first support element including an air communication passage which allows air communication between the at least partially hollow interior of the first support element and the article;

a second support element associated with the platform, the second support element operable to interface with the airflow outlet of the drying device, the second support element in air communication with the at least partially hollow interior of the first support element, wherein an airflow channel is formed between the drying chamber, at least a portion of the article, the at least partially hollow interior of the first support element, the second support element, and the airflow outlet.

21. The support device of claim 20, wherein the platform has a slightly curved surface.

* * * * *